US011719048B2

(12) United States Patent
DePavia et al.

(10) Patent No.: US 11,719,048 B2
(45) Date of Patent: Aug. 8, 2023

(54) GEO-STEERING USING ELECTROMAGNETIC GAP IMPEDANCE DATA

(71) Applicant: Schlumberger Technology Corporation, Sugar Land, TX (US)

(72) Inventors: Luis Eduardo DePavia, Sugar Land, TX (US); Jiuping Chen, San Pablo, CA (US); Liang Sun, Katy, TX (US); Richard Hunter, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/060,498

(22) Filed: Oct. 1, 2020

(65) Prior Publication Data

US 2021/0095525 A1 Apr. 1, 2021

Related U.S. Application Data

(60) Provisional application No. 62/908,787, filed on Oct. 1, 2019.

(51) Int. Cl.

| | |
|---|---|
| ***E21B 7/04*** | (2006.01) |
| ***E21B 7/06*** | (2006.01) |
| ***E21B 47/0228*** | (2012.01) |
| ***E21B 49/08*** | (2006.01) |
| ***E21B 7/10*** | (2006.01) |
| ***E21B 47/13*** | (2012.01) |

(52) U.S. Cl.

CPC ..... *E21B 7/04* (2013.01); *E21B 7/068* (2013.01); *E21B 7/10* (2013.01); *E21B 47/0228* (2020.05); *E21B 47/13* (2020.05); *E21B 49/087* (2013.01)

(58) Field of Classification Search

CPC .... E21B 7/068; E21B 47/0228; E21B 49/087; E21B 7/10; E21B 47/13; E21B 49/00; E21B 7/04; G06N 20/00

See application file for complete search history.

(56) References Cited

U.S. PATENT DOCUMENTS

| | | | | |
|---|---|---|---|---|
| 7,703,548 | B2 * | 4/2010 | Clark | E21B 47/0228 175/45 |
| 7,962,287 | B2 * | 6/2011 | Clark | E21B 47/0228 702/7 |
| 10,323,510 | B2 | 6/2019 | DePavia et al. | |
| 10,641,087 | B2 * | 5/2020 | Wilson | E21B 49/00 |
| 2009/0066334 | A1 * | 3/2009 | Peter | E21B 47/13 324/333 |
| 2018/0223655 | A1 * | 8/2018 | Wilson | G01V 3/38 |
| 2018/0245458 | A1 * | 8/2018 | Ma | H01Q 7/06 |
| 2021/0041596 | A1 * | 2/2021 | Kushwaha | G01V 11/00 |

* cited by examiner

*Primary Examiner* — Nicole Coy

(57) ABSTRACT

A method for steering a downhole tool includes receiving an electromagnetic (EM) signal from the downhole tool. The downhole tool is in a wellbore in a formation. The EM signal comprises a gap voltage and a gap current that are measured across a gap sub in the downhole tool. The method also includes determining a gap impedance based at least partially upon the gap voltage and the gap current. The method also includes determining a first formation resistivity at a first location in the wellbore based at least partially upon the gap impedance. The method also includes steering the downhole tool based at least partially upon the first formation resistivity.

20 Claims, 13 Drawing Sheets

GEO-STEERING USING ELECTROMAGNETIC GAP IMPEDANCE DATA

CROSS-REFERENCE TO RELATED APPLICATIONS

This application claims priority to U.S. Provisional Patent Application No. 62/908,787, filed on Oct. 1, 2019, which is hereby incorporated by reference in its entirety.

BACKGROUND

In the process of drilling a wellbore, geo-steering may be used to adjust the wellbore trajectory (e.g., inclination and azimuth angles) in real-time to reach one or more geological targets. These adjustments may be based on geological information that is gathered while drilling. Geo-steering may be used to maintain a wellbore in a particular section of a reservoir to minimize gas or water breakthrough, maximize production from the wellbore, and extend wellbore life.

Drilling operations tend to use the bare minimum number of tools in a bottom hole assembly (BHA) to reduce cost. Consequently, many wellbores drilled in the basins in North America use measurement-while-drilling (MWD) tools, with total gamma ray radiation measurements to identify formations and geological boundaries for wellbore-placement. This may yield incomplete and/or inaccurate geological information that is used to geo-steer the BHA, which may result in an undesirable wellbore trajectory. Other BHAs use "look-ahead" technologies based upon sonic or resistivity data to geo-steer the BHA; however, use of this technology is very expensive. Therefore, it would be desirable to have improved systems and methods for geo-steering.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A method for steering a downhole tool is disclosed. The method includes receiving an electromagnetic (EM) signal from the downhole tool. The downhole tool is in a wellbore in a formation. The EM signal includes a gap voltage and a gap current that are measured across a gap sub in the downhole tool. The method also includes determining a gap impedance based at least partially upon the gap voltage and the gap current. The method also includes determining a first formation resistivity at a first location in the wellbore based at least partially upon the gap impedance. The method also includes steering the downhole tool based at least partially upon the first formation resistivity.

In another embodiment, the method includes transmitting a first electromagnetic (EM) signal from the downhole tool to a computing system at the surface. The downhole tool is in a wellbore in a formation. The method also includes measuring a gap voltage across a gap sub in the downhole tool while the first EM signal is being transmitted. The method also includes measuring a gap current across the gap sub in the downhole tool while the first EM signal is being transmitted. The method also includes transmitting a second EM signal from the downhole tool to the computing system. The second EM signal includes the gap voltage and the gap current. The method also includes steering the drill bit based at least partially upon the gap voltage and the gap current.

A system for steering the downhole tool is also disclosed. The system includes a downhole tool configured to transmit an electromagnetic (EM) telemetry signal. The downhole tool includes a gap sub and a sensor configured to measure a gap voltage and a gap current across the gap sub. The system also includes a computing system configured to receive the EM telemetry signal. The EM telemetry signal includes the gap voltage and the gap current. The computing system is also configured to determine a gap impedance based at least partially upon the gap voltage and the gap current. The system is also configured to determine a formation resistivity around the downhole tool based at least partially upon the gap impedance. The system is also configured to steer the downhole tool based at least partially upon the formation resistivity.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object or step could be termed a second object or step, and, similarly, a second object or step could be termed a first object or step, without departing from the scope of the present disclosure. The first object or step, and the second object or step, are both, objects or steps, respectively, but they are not to be considered the same object or step.

The terminology used in the description herein is for the purpose of describing particular embodiments and is not intended to be limiting. As used in this description and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Attention is now directed to processing procedures, methods, techniques, and workflows that are in accordance with some embodiments. Some operations in the processing procedures, methods, techniques, and workflows disclosed herein may be combined and/or the order of some operations may be changed.

FIG. 1 illustrates a schematic side view of a downhole tool 100, according to an embodiment. The downhole tool 100 may be or include a bottom hole assembly (BHA) including a first (e.g., upper) portion 110 and a second (e.g., lower) portion 120. The BHA may include a measurement-while-drilling (MWD) tool and/or a logging-while-drilling (LWD) tool. A drill bit 122 may be part of or coupled to the lower portion 120.

Figures 1A, 1B:
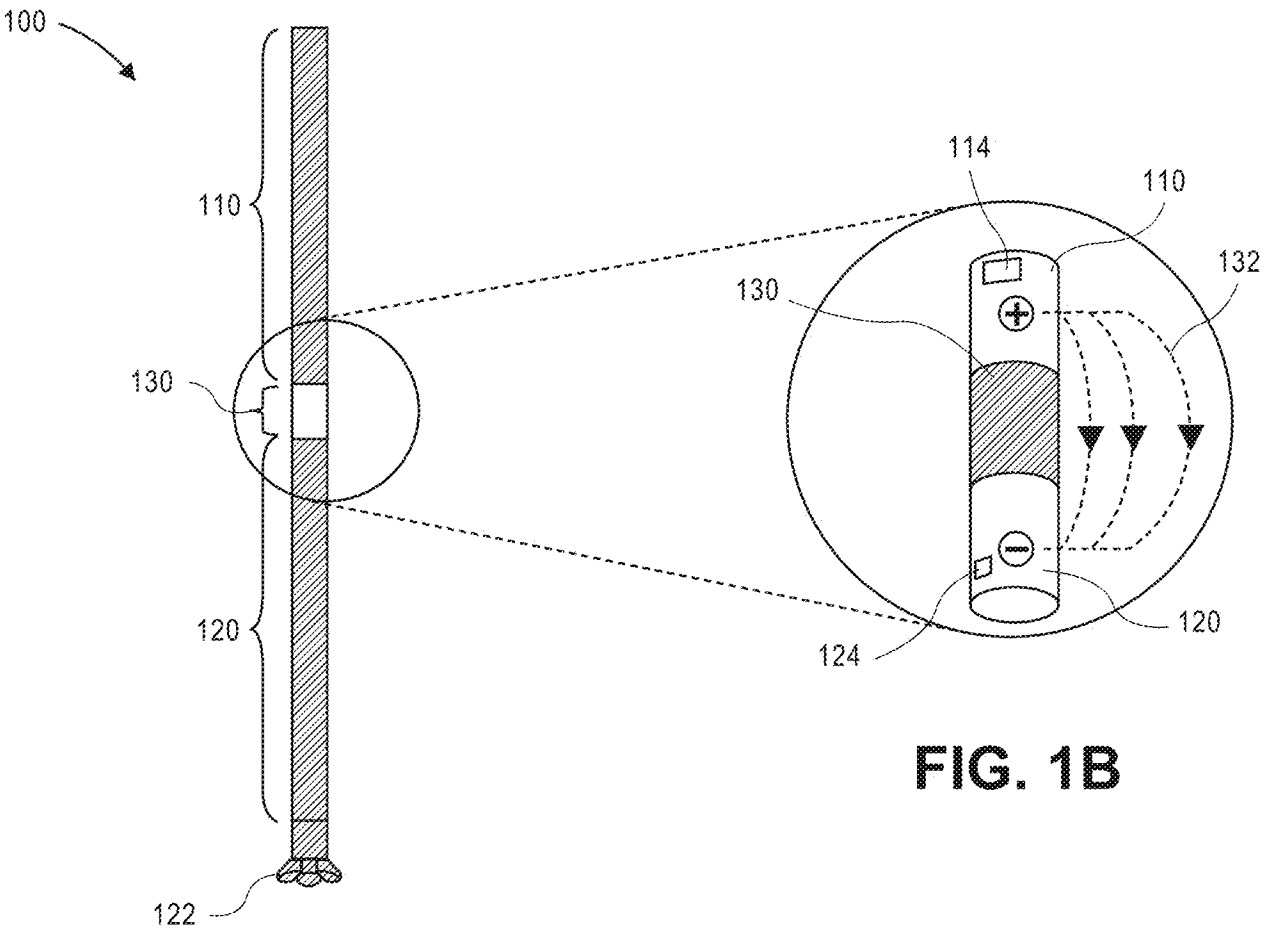
FIG. 1A illustrates a schematic side view of a downhole tool, according to an embodiment.
FIG. 1B illustrates an enlarged view of a portion of the downhole tool shown in FIG. 1A, according to an embodiment.

The downhole tool 100 may also include a gap sub 130 that is positioned between the upper and lower portions 110, 120. From an electromagnetic (EM) telemetry perspective, the downhole tool 100 may be viewed as a gap dipole model where the upper portion 110 serves as a first (e.g., positive) electrode, and the lower portion 120 serves as a second (e.g., negative) electrode. The gap sub 130 may include or define a gap across which electrical current 132 may flow from the upper portion 110 to the lower portion 120, or vice versa, as shown in FIG. 1B. The electrical current 132 may flow across the gap in the gap sub 130 and be injected into a drill string and/or the surrounding formation.

As described below, data related to the EM impedance of the gap sub 130 (also referred to as the EM gap impedance or EM gap impedance data) may be used to facilitate geo-steering of the downhole tool 100 (e.g., the drill bit 122) in the formation to control the trajectory of the wellbore. In one embodiment, one or more sensors (two are shown: 114, 124) in the downhole tool 100 may measure the electrical current 132 flowing across the gap sub 130. One or more of the sensors 114, 124 may also or instead measure the electrical voltage across the gap sub 130 (e.g., the voltage differential) simultaneously with electrical current 132 flowing across the gap sub 130. The impedance of the gap sub 130 may be determined by dividing the voltage by the current.

Numerical Simulation of Gap Impedance in EM Telemetry Tools

Figure 2:
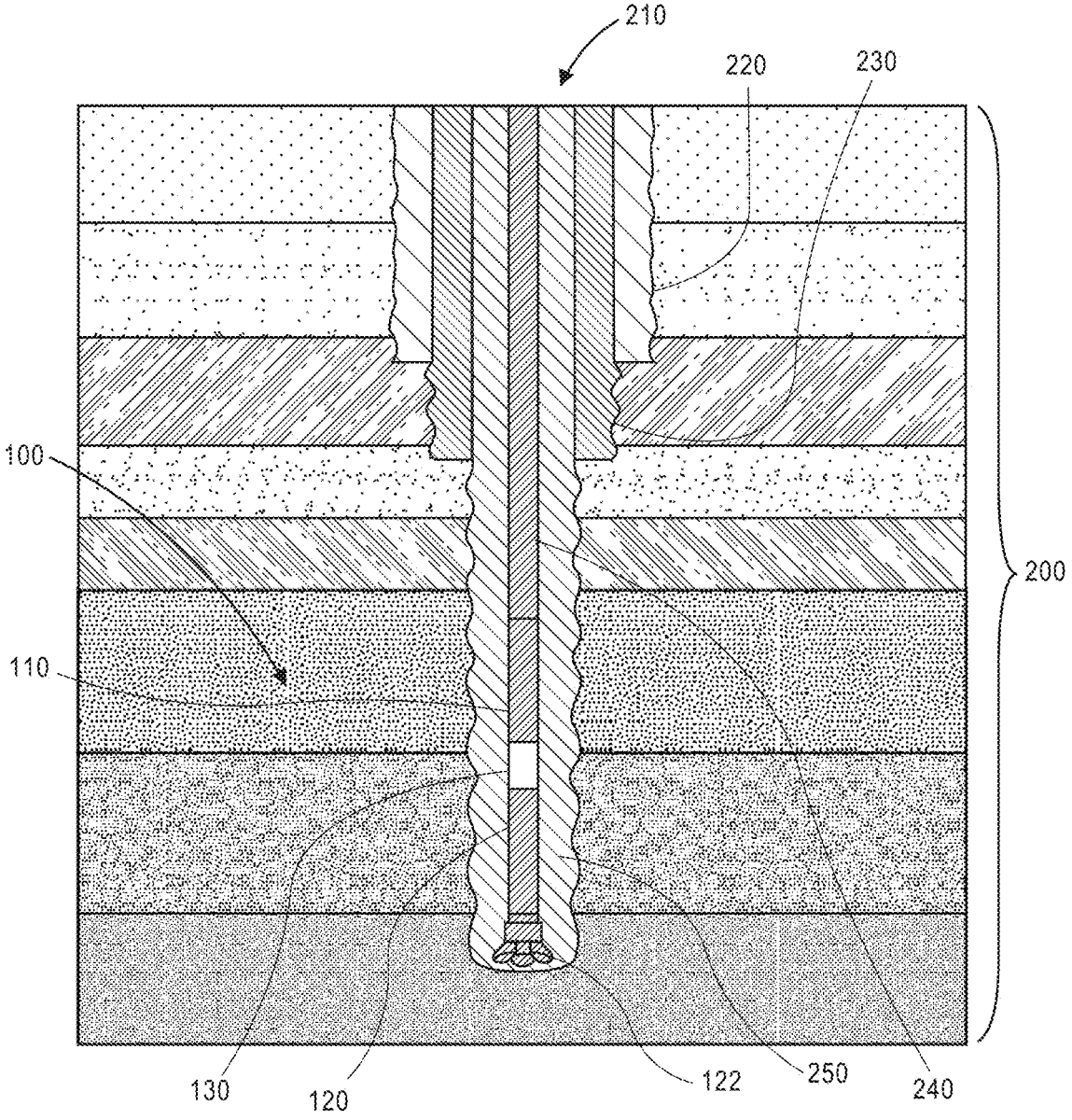
FIG. 2 illustrates a side schematic view of the downhole tool in a vertical wellbore, according to an embodiment.

FIG. 2 illustrates a side schematic view of the downhole tool 100 in a vertical wellbore 210 in a uniform or layered formation 200, according to an embodiment. The wellbore 210 may be or include an open-hole wellbore or a cased-hole wellbore. As shown, the wellbore 210 may include a first (e.g., outer) casing 220 and a second (e.g., inner) casing 230 that extends down below the outer casing 220. The downhole tool 100 may be lowered into the wellbore 210 with a drill string 240. A drilling fluid (e.g., drilling mud) 250 may be disposed in the downhole tool 100, the wellbore 210, the drill string 240, or a combination thereof.

As discussed in greater detail below, the downhole tool 100 may be geo-steered based at least partially upon the impedance across the gap sub 130 (i.e., the gap impedance). The gap impedance may be determined based at least partially upon an electrical field and/or a magnetic field that is generated by the electrical current 132 flowing across the gap in the gap sub 130. In at least one embodiment, an algorithm may be used to determine the electrical field and/or the magnetic field based at least partially upon the casing(s) 220, 230, the drill string 240, the drilling fluid 250, 1D or 2D axi-symmetric formation resistivity model(s), or a combination thereof. The algorithm may be or include a 2D finite element code, such as CWNLAT 2D code.

The amount of gap current that is used in an EM telemetry operation may be based at least partially upon the gap impedance. In another embodiment, the amount of voltage that is used in the EM telemetry operation may be based at least partially upon the gap impedance. In yet another embodiment, the amount of power that is used in the EM telemetry operation may be based at least partially upon the gap impedance. In addition, the gap impedance may affect the EM signal that is received by one or more stakes at the surface or by one or more deep electrodes positioned below the surface. Illustrative parameters that may affect gap impedance may include the resistivity of the formation 200, the drilling fluid 250, the contact between the downhole tool 100 and the formation 200, the length between the gap in the gap sub 130 and the drill bit 122, the geometry of the downhole tool 100, the geometry of the wellbore 210, or a combination thereof.

Gap Impedance's Sensitivity to a Formation Boundary

As described below, the gap impedance may be sensitive to formation resistivity, formation boundaries, and formation thickness. As a result, the formation resistivity, formation boundaries, and/or formation thickness may be used to facilitate geo-steering of the downhole tool 100.

Figure 3A:
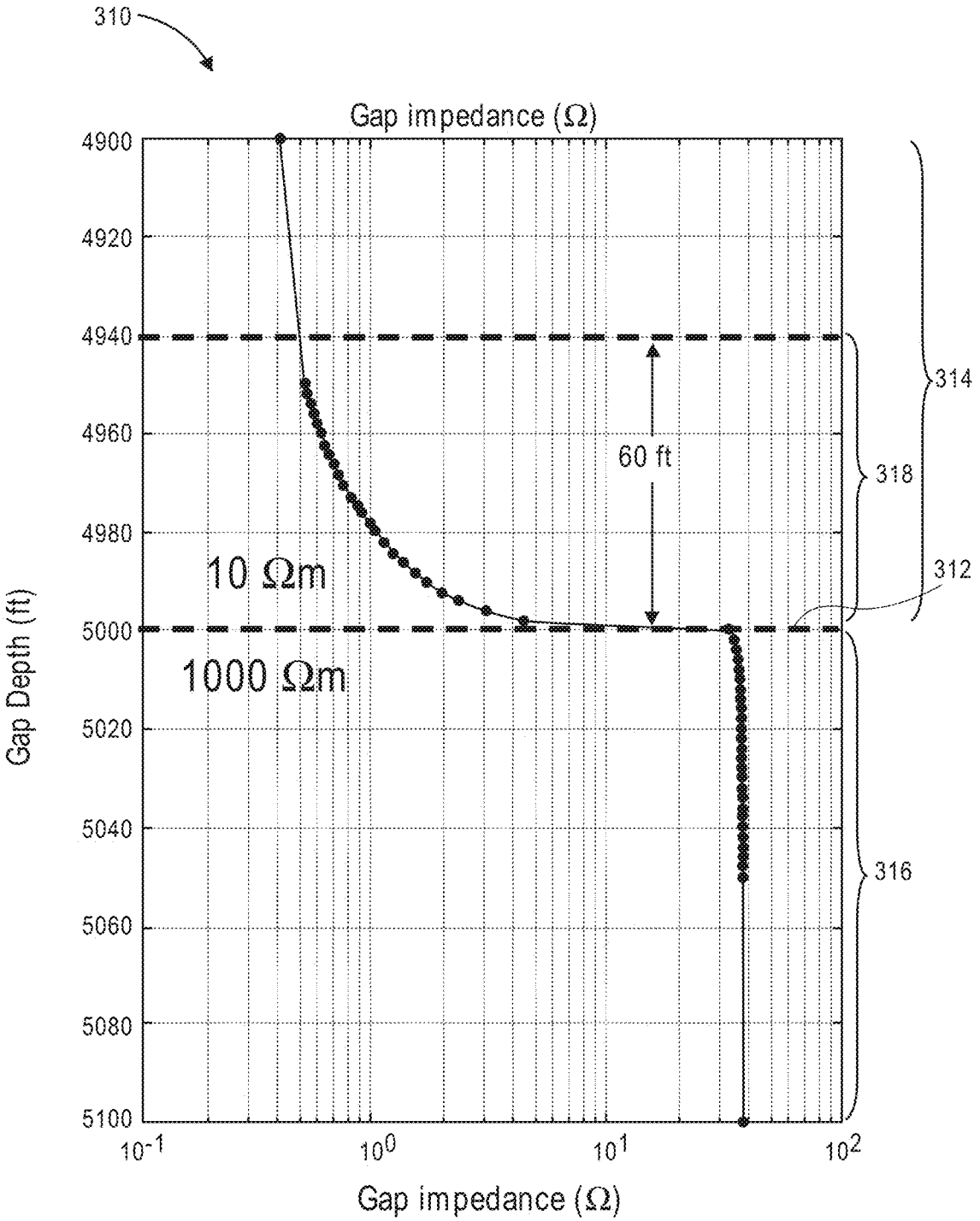
FIG. 3A illustrates a graph of electromagnetic (EM) gap impedance vs. gap depth when the downhole tool moves toward a boundary from 10 Ωm to 1000 Ωm, according to an embodiment.

FIG. 3A illustrates a graph 310 of gap impedance vs. gap depth when the downhole tool 100 moves toward a boundary 312 from 10 Ωm to 1000 Ωm, according to an embodiment. More particularly, in FIG. 3A, the downhole tool 100 (including the drill bit 122 and the gap sub 130) moves downward and crosses the boundary 312 between a first (e.g., upper) formation layer 314 having a 10 Ωm resistivity and a second (e.g., lower) formation layer 316 having a 1000 Ωm resistivity. In this example, the frequency is 2 Hz, the length between the gap sub 130 and the drill bit 122 (i.e., the gap-to-bit length) is 60 feet, and no drilling mud is used.

To illustrate the gap impedance sensitivity in a vertical direction, a zone 318 having the same length/depth as the gap-to-bit length (e.g., 60 feet) is identified extending upward from the boundary 312. As used herein, the terms "gap impedance sensitivity" and/or "vertical sensitivity" refer to the change of gap impedance due to the formation boundary 312 in the vertical direction. When both the drill bit 122 and the gap sub 130 are in the upper formation layer 314 (10 Ωm), the gap impedance is about a constant 0.4Ω. When the gap sub 130 enters the zone 318 (10 Ωm), the drill 122 bit enters the lower formation layer 316 (1000 Ωm). As a result, the gap impedance monotonically increases, and reaches a maximum value of about 40Ω when the gap sub 130 is at the boundary 312 (e.g., a depth of about 5,000 feet). When the gap sub 130 crosses the boundary 312 into the lower formation layer 316 (1000 Ωm), the gap impedance remains constant at about 40Ω.

Figure 3B:
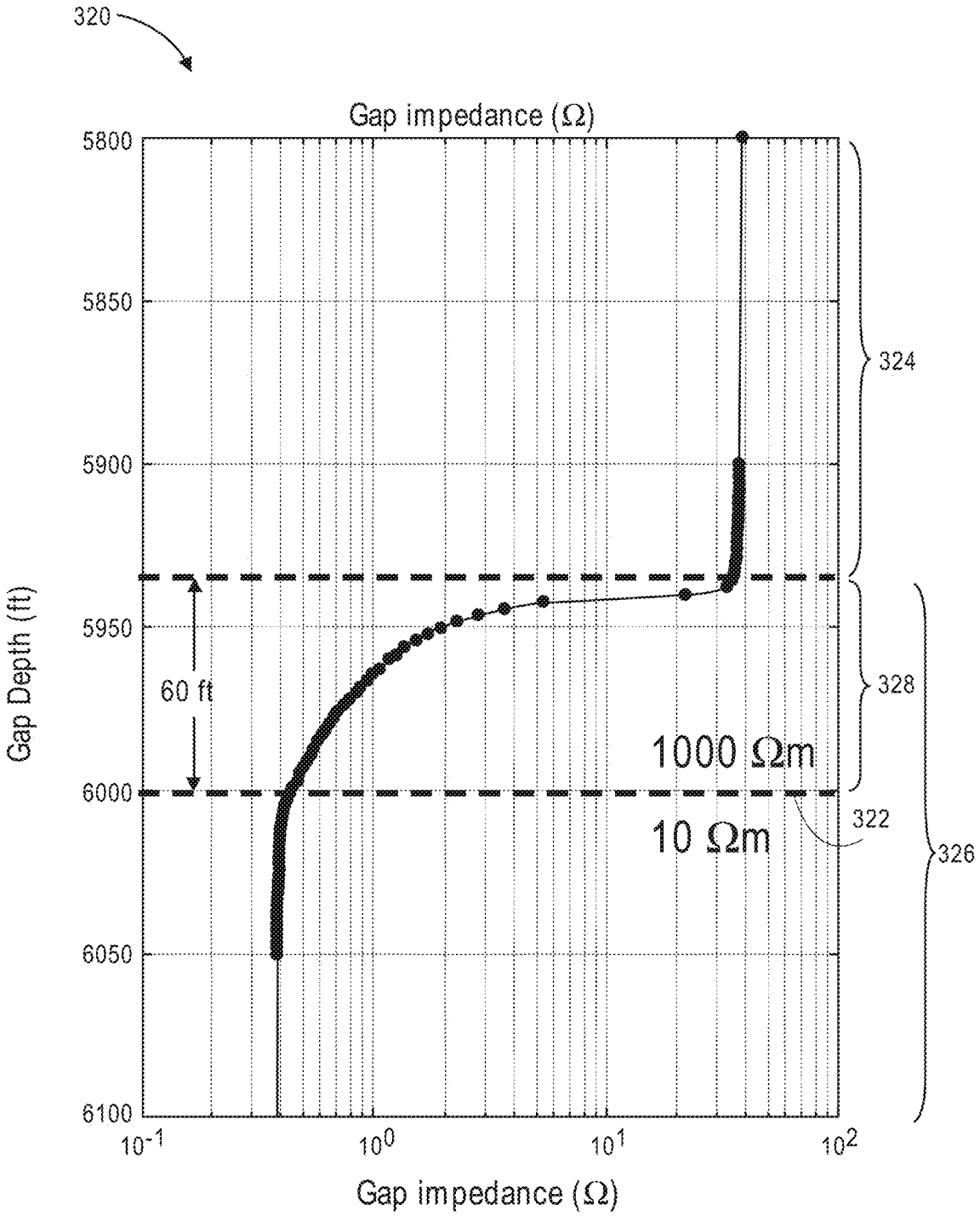
FIG. 3B illustrates a graph of EM gap impedance vs. gap depth when the downhole tool moves toward a boundary from 1000 Ωm to 10 Ωm, according to an embodiment.

FIG. 3B illustrates a graph 320 of gap impedance vs. gap depth when the downhole tool 100 moves toward a boundary 322 from 1000 Ωm to 10 Ωm, according to an embodiment. More particularly, in FIG. 3B, the downhole tool 100 (including the drill bit 122 and the gap sub 130) moves downward and crosses the boundary 322 between a first (e.g., upper) formation layer 324 having a 1000 Ωm resistivity and a second (e.g., lower) formation layer 326 having a 10 Ωm resistivity. In this example, the frequency is 2 Hz, the gap-to-bit length is 60 feet, and no drilling mud is used.

The gap impedance may be sensitive to the formation layer between the drill bit 122 and the gap sub 130. In other words, the vertical sensitivity may be substantially equivalent to the gap-to-bit length (e.g., 60 feet in this example). This is verified by the results shown in FIG. 3B, in which the drill bit 122 crosses the boundary 322 at 6,000 feet, which separates the upper formation layer 324 (1,000 Ωm) from the lower formation layer 326 (10 Ωm). As shown, when both the drill bit 122 and the gap sub 130 are in the upper formation layer 314 (1000 Ωm), the gap impedance is about a constant 40Ω. When the gap sub 130 enters the zone 328 (1000 Ωm), the drill 122 bit enters the lower formation layer 326 (10 Ωm). As a result, the gap impedance rapidly decreases, and reaches a minimum value of about 0.4Ω when the gap sub 130 is at the boundary 322 (e.g., a depth of about 6,000 feet). When the gap sub 130 crosses the boundary 322 into the lower formation layer 326 (10 Ωm), the gap impedance remains constant at about 0.4Ω.

The example in FIG. 3A also shows look-ahead sensitivity of gap impedance. As used herein, "look-ahead sensitivity" refers to the gap impedance change seen through the drill bit 122 which is ahead of (e.g., below) the gap sub 130. In the example, the look-ahead length is the same as the distance from the gap sub 130 to the drill bit 122. As used herein, "early boundary detection" refers to the look-ahead sensitivity to a boundary between formation layers. When the drill bit 122 contacts the formation boundary 312, the impedance begins to change. For example, when the gap sub 130 descends through the zone 318, the gap impedance increases gradually. However, in the example of FIG. 3B, when the gap sub 130 descends through the zone 328, the gap impedance decreases at faster rate. As may be seen, after few feet into the lower formation layer 326 (10 Ωm), the measurement decreases by about an order of magnitude.

Gap Impedance's Sensitivity to Formation Thickness

As mentioned above, the vertical sensitivity of the gap impedance may be substantially the same as the gap-to-bit length (e.g., 60 feet). This may be valid as long as the formation thickness is greater than the gap-to-bit length. This is confirmed in FIG. 4A, which illustrates a graph 410 of gap impedance vs. gap depth in a formation layer having a thickness of 200 feet, according to an embodiment. The example of FIG. 4A includes a first (e.g., upper) layer 412 having a resistivity of 10 Ωm, a second (e.g., middle) layer 414 having a resistivity of 1000 Ωm, and a third (e.g., lower) layer 416 having a resistivity of 10 Ωm. The thickness of the middle layer 414 is 200 feet, which is greater than the gap-to-bit length. It may be observed that the gap impedance shows the sensitivity to formation boundary changes. Testing with different mud resistivities of 0.1 Ωm, 1 Ωm, 10 Ωm, and 40,000 Ωm was performed, covering brine, water-based-mud (WBM), and oil-based-mud (OBM), and similar results were observed. Thus, the impedance and the formation resistivity may depend at least partially upon the mud and the properties thereof.

Figure 4A:
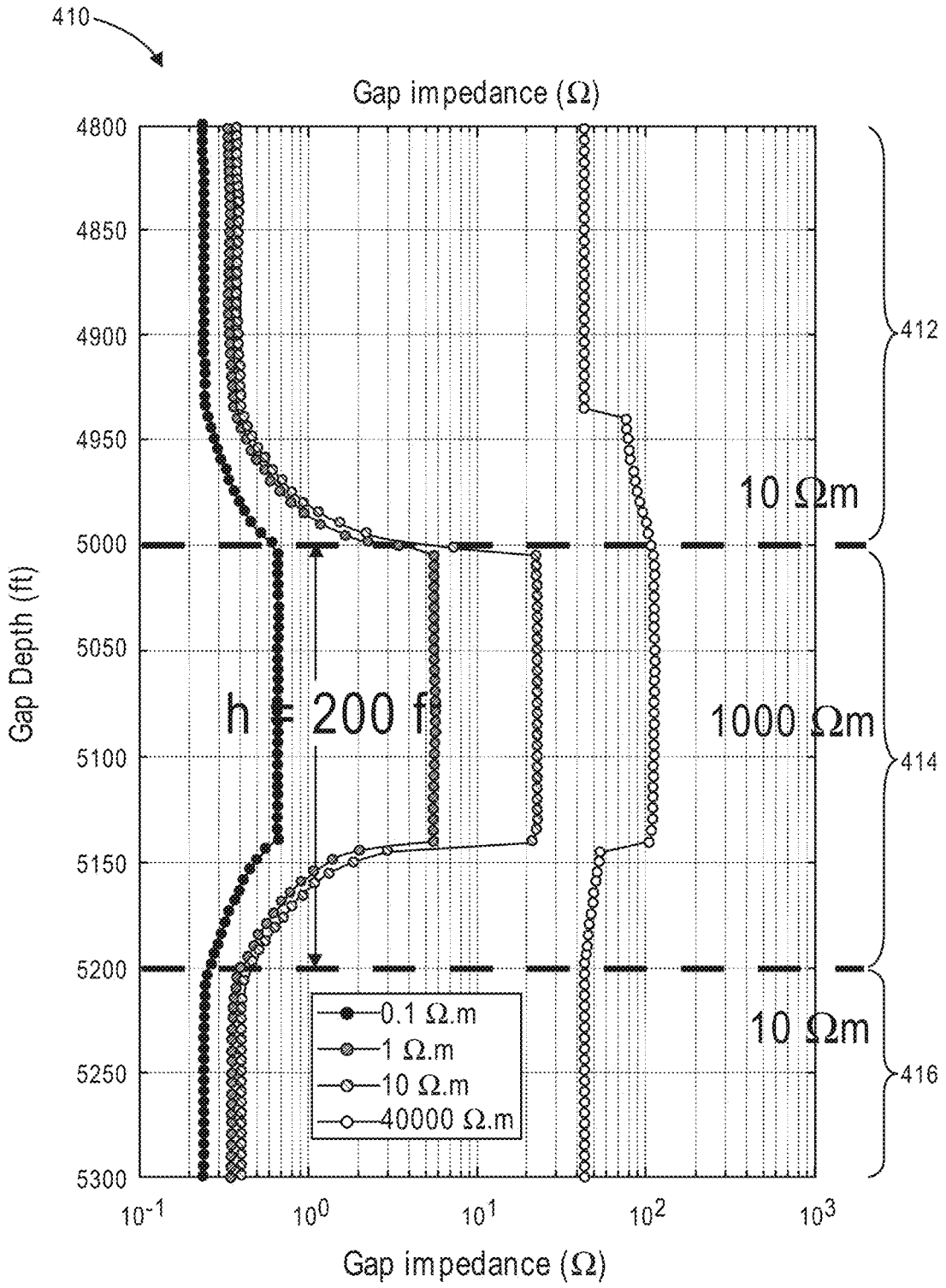
FIG. 4A illustrates a graph of EM gap impedance vs. gap depth at a formation thickness of 200 feet, according to an embodiment.
Figure 4B:
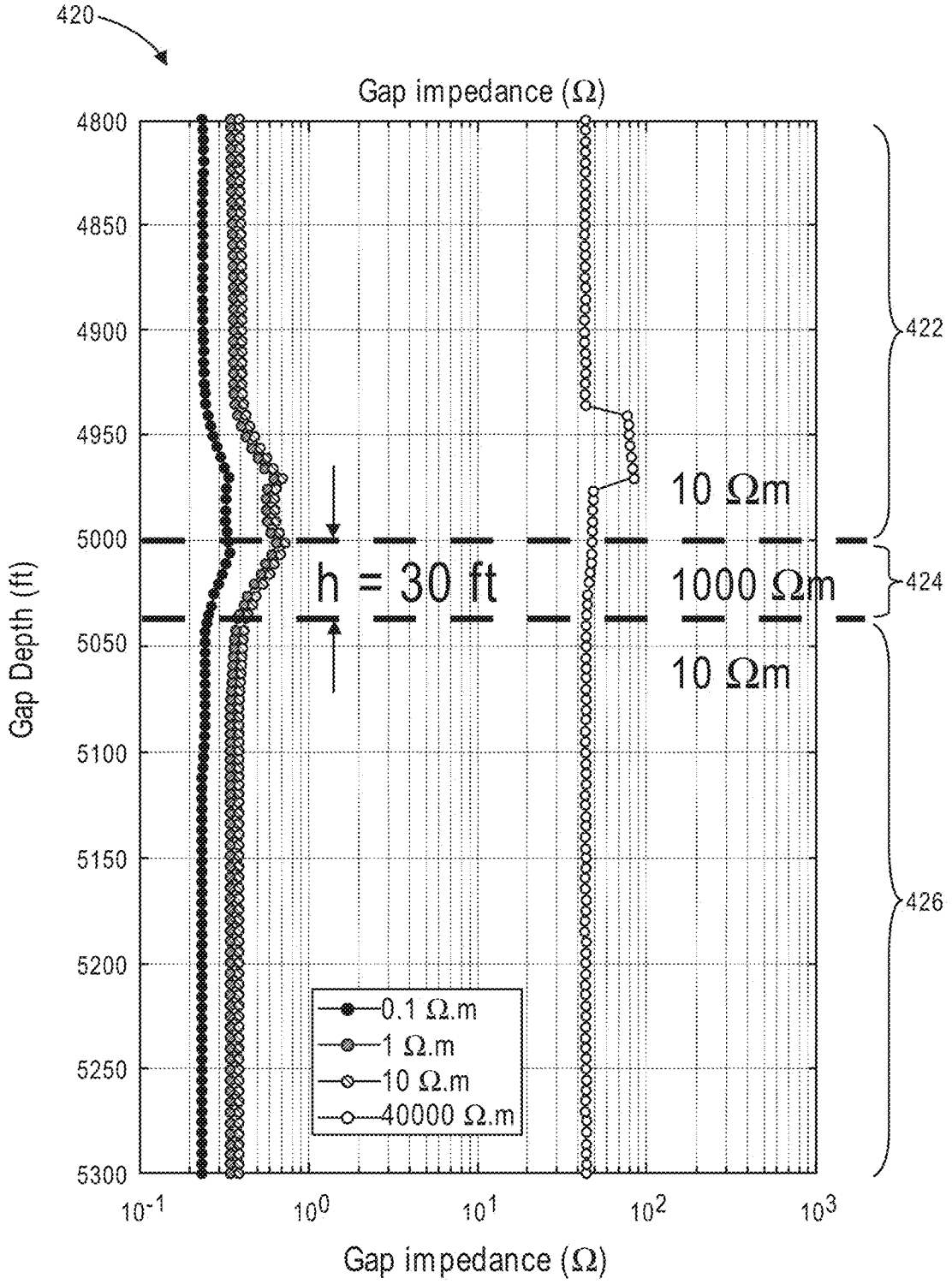
FIG. 4B illustrates a graph of EM gap impedance vs. gap depth at a formation thickness of 30 feet, according to an embodiment.

If a thin layer in the formation is encountered (e.g., having a thickness less than the gap-to-bit length), the behavior of the gap impedance may differ from that shown in FIG. 4A. This is demonstrated in FIG. 4B, which illustrates a graph 420 of gap impedance vs. gap depth in a formation layer having a thickness of 30 feet, according to an embodiment. More particularly, FIG. 4B includes a first (e.g., upper) layer 422 having a resistivity of 10 Ωm, a second (e.g., middle) layer 424 having a resistivity of 1000 Ωm, and a third (e.g., lower) layer 426 having a resistivity of 10 Ωm. The thickness of the middle layer 424 is 30 feet, which is less than the gap-to-bit length. In this example, the gap impedance at any depth is affected by the layers 422, 424, and/or 426 in the vertical sensitivity range, combined with drilling fluid's effect, making the interpretation more difficult compared with its thick formation counterpart (in FIG. 4A).

The vertical sensitivity to a formation boundary may be substantially the same as the gap-to-bit length. Early detection of boundary changes may be performed when the formation thickness is greater than a predetermined amount (e.g., greater than the gap-to-bit length). The rate of gap impedance change may depend on the resistivity contrast. For example, in OBM, there may be an instantaneous transition of gap impedance when the drill bit 122 contacts the boundary, regardless of whether the boundary is from high resistivity to low resistivity or vice versa. In another example, in WBM, there may be a gradual impedance change in transition when the drill bit 122 contacts the boundary, transitioning either from high resistivity to low resistivity or from low resistivity to high resistivity. The gap impedance may be sensitive to formation thickness. When the thickness of the formation layer is less than the gap-to-bit length, the sensitivity may be reduced. The gap impedance behavior may be different in WBM and OBM.

Measured Gap Impedance Data in EM Telemetry

Figure 5A:
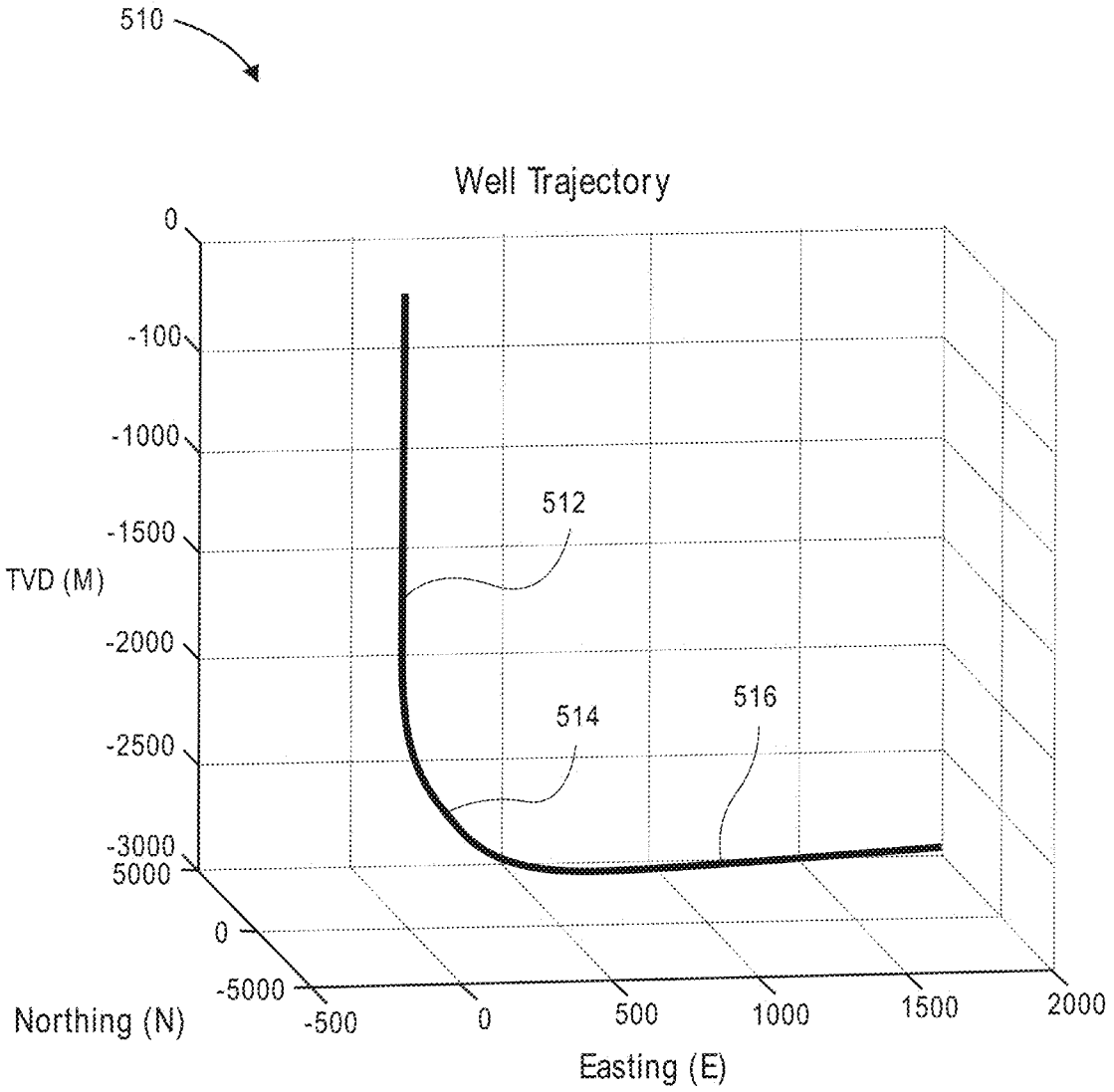
FIG. 5A illustrates a graph of a trajectory of a wellbore, according to an embodiment.

FIGS. 5A-5E illustrate graphs corresponding to a drilling operation. More particularly, FIG. 5A illustrates a graph 510 of a trajectory of a wellbore, according to an embodiment. As may be seen in FIG. 5A, the wellbore includes a substantially vertical portion 512, a curved portion 514, and a substantially horizontal portion 516. The vertical portion 512 transitions to the curved portion 514 at a measured depth of about 2000 feet, and the curved portion 514 transitions to the horizontal portion 516 at a measured depth of about 3000 feet.

Figure 5C:
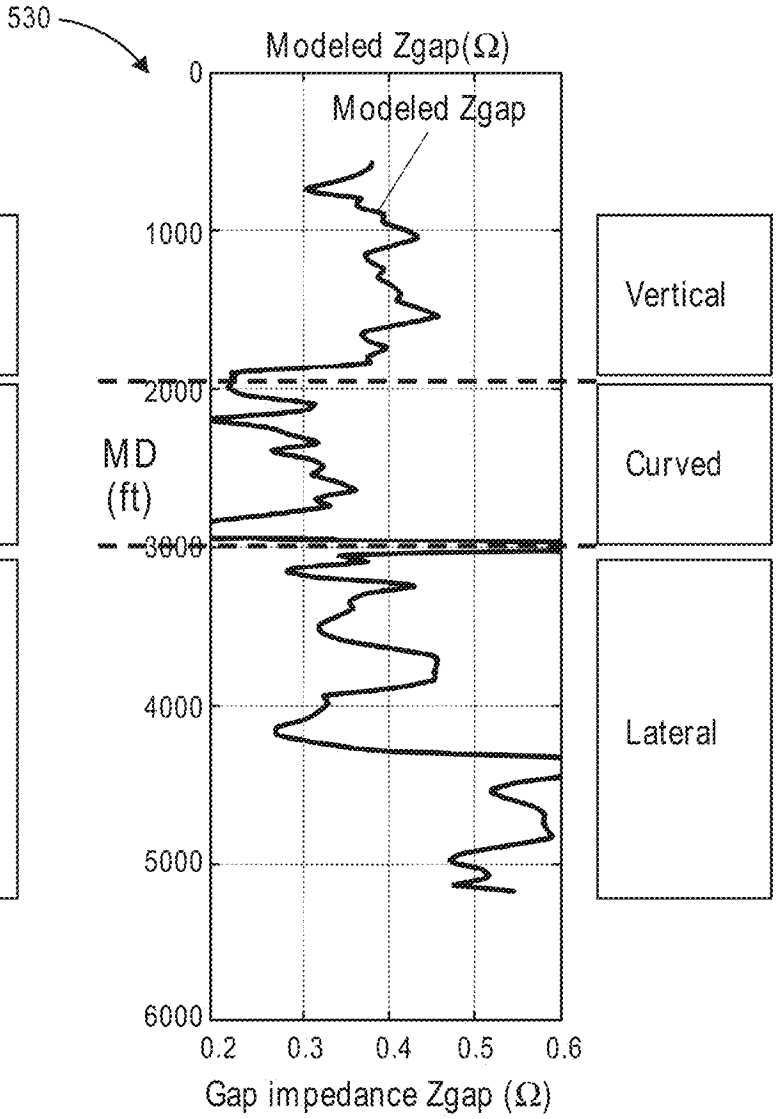
FIG. 5C illustrates a graph of modeled gap impedance ($Z_{gap}$) vs. depth, according to an embodiment.
Figure 5B:
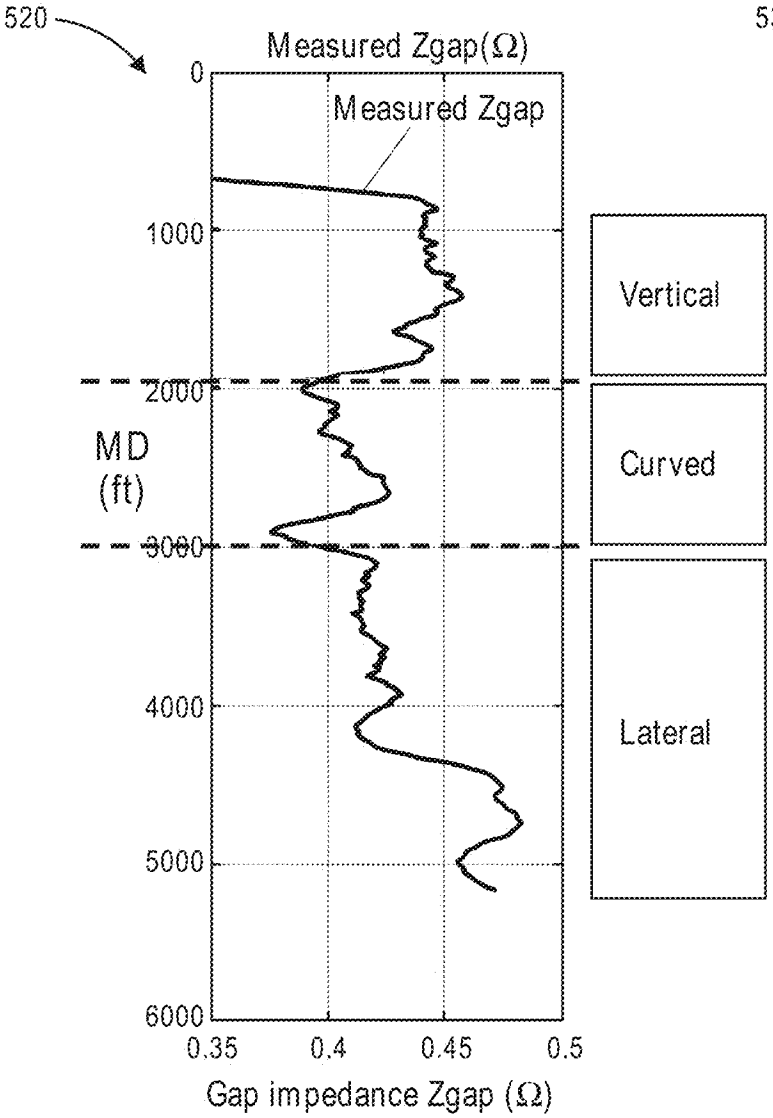
FIG. 5B illustrates a graph of measured EM gap impedance ($Z_{gap}$) vs. depth, according to an embodiment.
Figure 5E:
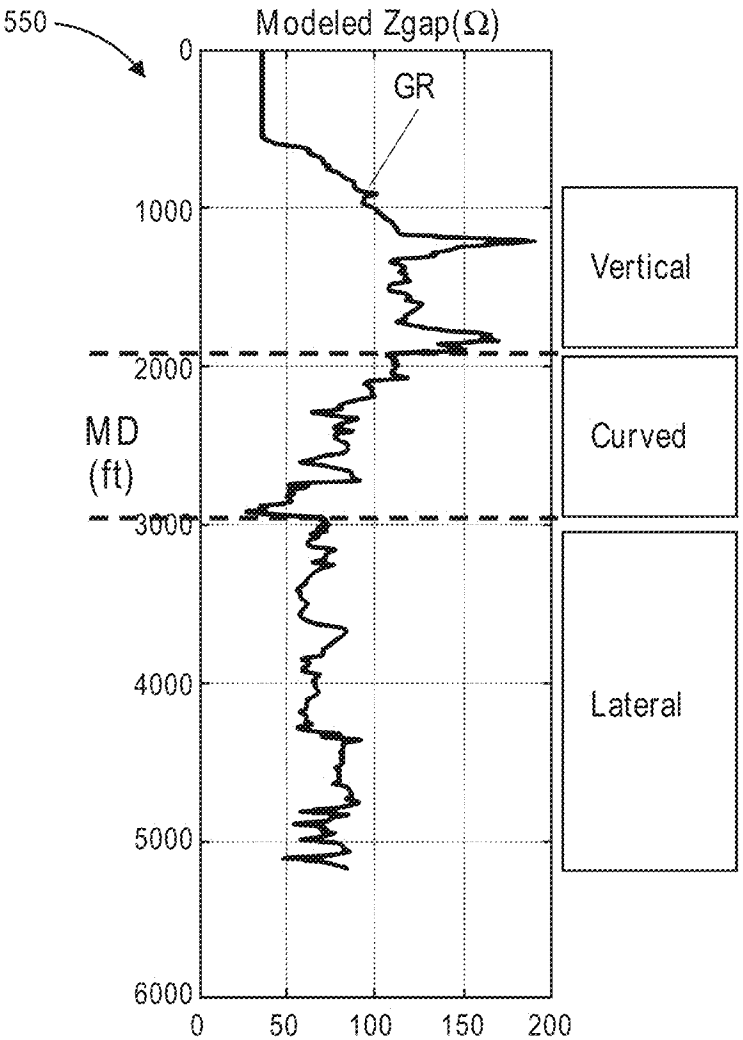
FIG. 5E illustrates a graph of gamma ray radioactivity (API) vs. depth, according to an embodiment.
Figure 5D:
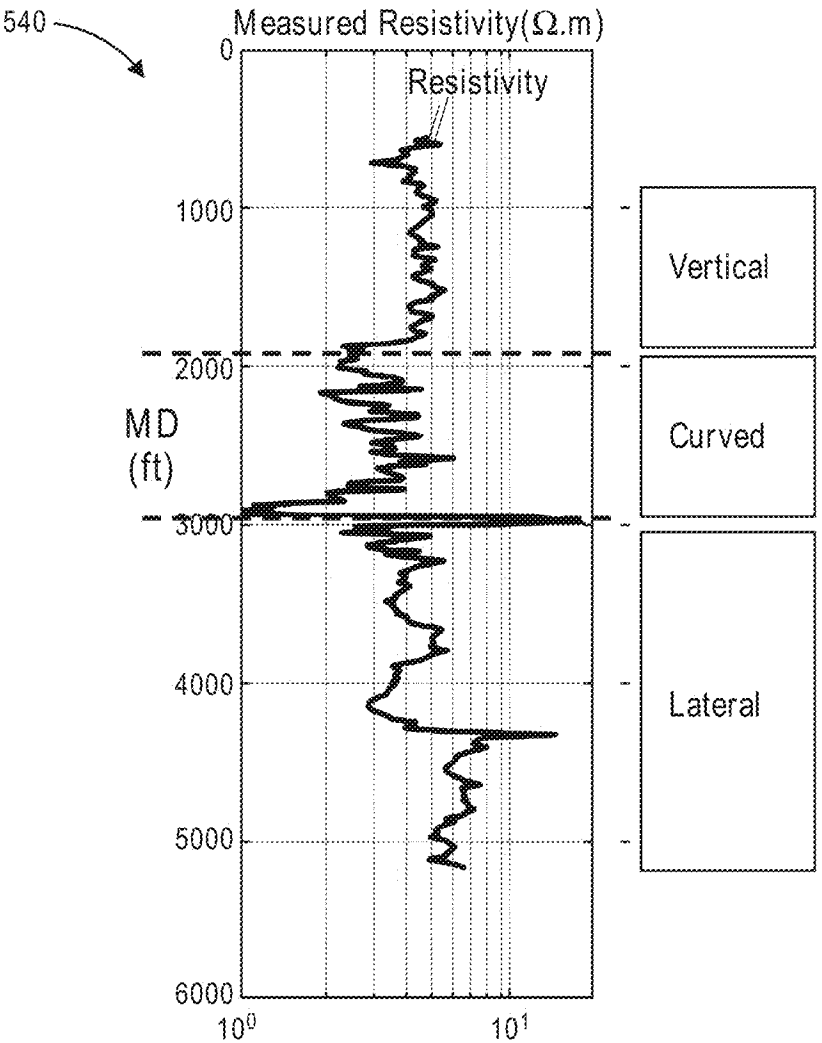
FIG. 5D illustrates a graph of measured resistivity vs. depth, according to an embodiment.

FIG. 5B illustrates a graph 520 of measured gap impedance ($Z_{gap}$) vs. depth, according to an embodiment. FIG. 5C illustrates a graph 530 of modeled gap impedance ($Z_{gap}$) vs. depth, according to an embodiment. FIG. 5D illustrates a graph 540 of measured resistivity vs. depth, according to an embodiment. FIG. 5E illustrates a graph 550 of gamma ray radioactivity (API units) vs. depth, according to an embodiment.

As may be seen, the modeled gap impedance in graph 530 correlates directly with the measured resistivity in graph 540 in the vertical portion 512, the curved portion 514, and the horizontal portion 516. More particularly, the graph 530 illustrates the transition from low resistivity to high resistivity that occurs at 3000 feet. The measured gap impedance in graph 520 substantially correlates directly with the modeled gap impedance in graph 530 and the measured resistivity in graph 540.

Figure 6:
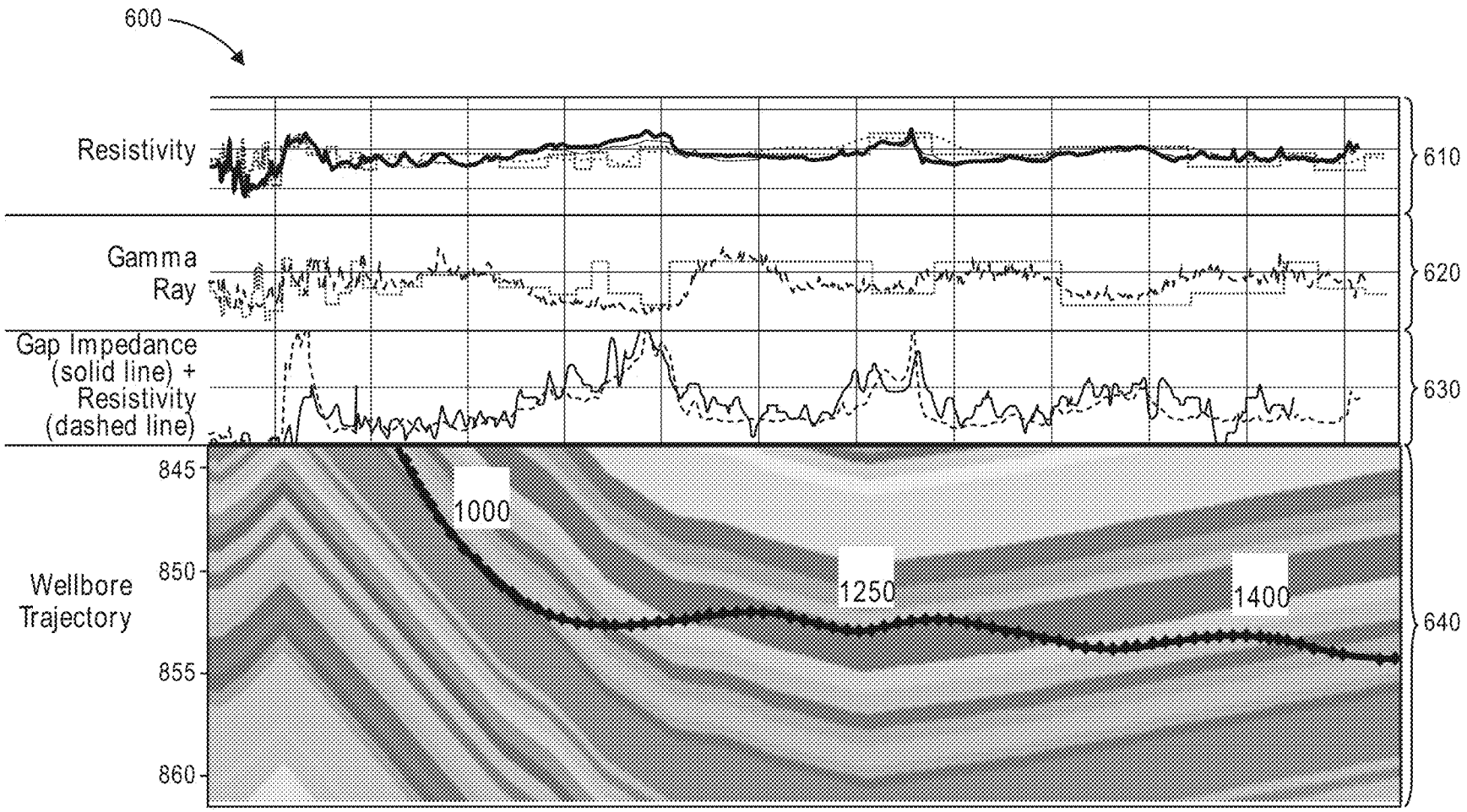
FIG. 6 illustrates a graph including four tracks, according to an embodiment. The first track represents resistivity vs. depth. The second track represents gamma ray (API) vs. depth. The third track represents gap impedance (solid) and resistivity (dashed) vs. depth. The fourth track represents the wellbore trajectory embedded in a gamma ray image.

FIG. 6 illustrates a graph 600 including four tracks: 610, 620, 630, 640, according to an embodiment. The first track 610 represents resistivity vs. depth. The second track 620 represents gamma ray radioactivity (API units) vs. depth. The third track 630 represents measured gap impedance (solid) and resistivity (dashed) vs. depth. The fourth track 640 represents a curtain section of the wellbore trajectory embedded in a known/supposed gamma ray image. The gap impedance shows a high correlation with formation resistivity, which suggests that a similar curtain image can be created beforehand. Once the gap impedance data is available, the gap impedance may be converted into formation resistivity, and then geo-steering may be performed using the gamma ray data. This is described in greater detail below.

Figure 7:
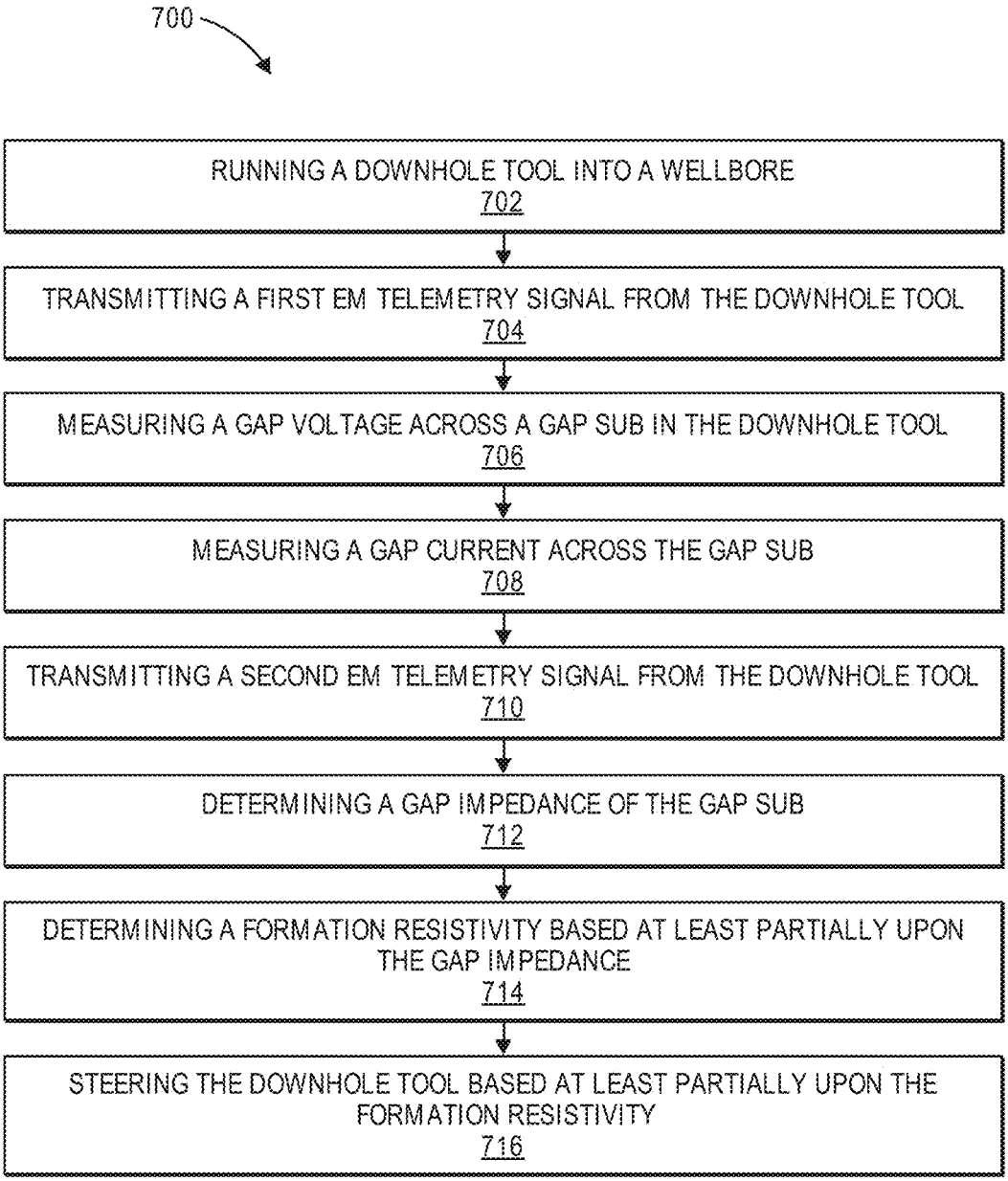
FIG. 7 illustrates a flowchart of a method for steering a downhole tool, according to an embodiment.

FIG. 7 illustrates a flowchart of a method 700 for steering the downhole tool 100 (e.g., the drill bit 122), according to an embodiment. An illustrative order of the method 700 is provided below; however, one or more portions of the method 700 may be performed in a different order or omitted. In addition, as mentioned below, one or more portions of the method 700 may be iterative and performed at different depths and/or different times to detect changes in formation resistivity that may be used to help steer the downhole tool 100.

The method 700 may include running the downhole tool 100 into the wellbore 210, as at 702. The method 700 may also include transmitting a first EM telemetry signal from the downhole tool 100, as at 704. The first EM telemetry signal may include measurement data obtained by the downhole tool 100. For example, the measurement data may be obtained by a MWD tool and/or a LWD tool in the downhole tool 100. The first EM telemetry signal may be transmitted when the downhole tool 100 is at a first depth, at a first time, and/or in a first formation layer. As used herein, "depth" may refer to either the vertical distance below the surface or the length of the wellbore 210, which may be greater than the vertical distance below the surface if the wellbore 210 includes one or more curved, deviated, and/or horizontal portions.

The method 700 may also include measuring a gap voltage across a gap sub 130 in the downhole tool 100, as at 706. The gap voltage may be generated by the transmission of the first EM telemetry signal. Thus, the gap voltage may be measured during the transmission of the first EM telemetry signal and represent the gap voltage at the first depth, the first time, and/or in the first formation layer. The gap voltage may be measured using one or more of the sensors 114, 124 (e.g., the voltage differential between the sensors 114, 124) in the downhole tool 100.

The method 700 may also include measuring a gap current 132 across the gap sub 130, as at 708. The gap current 132 may also be generated by the transmission of the first EM telemetry signal. Thus, the gap current 132 may be measured during the transmission of the first EM telemetry signal and represent the gap current 132 at the first depth, at the first time, and/or in the first formation layer. The gap current 132 may be measured using one or more of the sensors 114, 124 in the downhole tool 100.

In at least one embodiment, the method 700 may also include transmitting a second EM telemetry signal from the downhole tool 100, as at 710. The second EM telemetry signal may include the gap voltage of 706 and the gap current of 708, as well as other measurement data obtained by the downhole tool 100, such as a type of mud in the wellbore 210 proximate to the downhole tool 100. However, in other embodiments, the gap voltage of 706 and/or the gap current of 708 may be transmitted as part of the first EM telemetry signal or as part of another wired or wireless signal.

The second EM telemetry signal may be transmitted when the downhole tool 100 is at or proximate to the first depth, the first time, and/or in the first formation layer. For example, the second EM telemetry signal may be transmitted within a predetermined duration after the first EM telemetry signal, and the predetermined duration may be 5 minutes, 1 minute, 30 seconds, 10 seconds, 5 seconds, or less. The first and/or second EM telemetry signals may be transmitted while the downhole tool 100 is drilling, or they may be transmitted while drilling is paused. The first and/or second EM telemetry signals may be received and analyzed by a computing system 900 at the surface. The computing system 900 is described below with reference to FIG. 9.

The method 700 may include determining a gap impedance of the gap sub 130, as at 712. The gap impedance may be a function of the formation resistivity, the thickness of the layers in the formation, the mud resistivity, and the gap-to-bit length. Thus, changes in formation resistivity may cause changes in the gap impedance. In other words, the gap impedance may be sensitive to changes in the formation resistivity. As a result, determining the gap impedance may be used to determine the formation resistivity and then to geo-steer the downhole tool 100, as discussed below. In at least one embodiment, the gap impedance may be determined (e.g., by the computing system 900) based at least partially upon the gap voltage of 706 and the gap current of 708. For example, the gap impedance may be determined by dividing the gap voltage by the gap current.

The method 700 may also include determining the formation resistivity based at least partially upon the gap impedance, as at 714. The formation resistivity may be determined by the computing system 900. The formation resistivity may be determined proximate to the gap sub 130, at least partially between the gap sub 130 and the drill bit 122, proximate to the drill bit 122, ahead of the drill bit 122, or a combination thereof. In at least one embodiment, determining the formation resistivity may include training a neural network with input data and output data. For example, the input data may be or include the type and/or resistivity of the mud and the formation resistivity, and the output data may be or include the measured gap impedance. The input data and the output data may be obtained in the wellbore 210 and/or one or more other wellbores in the same formation layer (e.g., reservoir or target zone) at a plurality of depths.

The type of the mud, the resistivity of the mud, or both may be measured in the wellbore 210 (e.g., by the downhole tool 100) as well as in the other wellbores. The formation resistivity data may be estimated in the wellbore 210 as well as the other wellbores. For example, when a wellbore is drilled for production, the operator may know the particular formation layer that is targeted to maximize hydrocarbon production. Based on this information, the operator may be able to estimate the formation resistivity (e.g., to within about 5Ω to about 50Ω) of the particular layer. The impedance data may be measured in the wellbore 210 as well as the other wellbores (e.g., offsets) in the same manner as described above (e.g., in 702-712).

The input data and the output data for the neural network or model may be loaded into a library during a training phase and/or prediction phase of the neural network. As discussed above (e.g., with respect to FIGS. 3A, 3B, 4A, and 4B), the gap impedance in a particular formation layer may have a direct relationship with the formation resistivity in the formation layer. Thus, each entry of gap impedance data in the library may have a corresponding entry of formation resistivity data in the library. Once the library is populated, it may be used to train the neural network to predict formation resistivity based at least partially upon gap impedance.

Once the neural network is trained, the neural network may predict the formation resistivity around the downhole tool 100 in substantially real-time based at least partially upon the mud resistivity and/or the gap impedance (determined at 712). For example, the gap impedance (determined at 712) may be compared to the gap impedance data in the library. One or more entries of gap impedance data in the library that are most similar to the gap impedance (determined at 712) may be identified. It may then be predicted that the formation resistivity around the downhole tool 100 is the same as or similar to the formation resistivities in the library that correspond to the identified gap impedance data.

To quantify the performance of the trained neural network, root mean squared error (RMSE) or normalized RMSE (NRMSE) may be used to determine how well the trained neural network is performing. The RMSE and NRMSE may be determined as follows:

$$RMSE = \sqrt{\frac{1}{N}\sum_{i=0}^{N}(y_i - \bar{y}_i)^2} \quad \text{EQ. 1}$$

$$NRMSE = 100 \times \sqrt{\frac{1}{N}\sum_{i=0}^{N}[(y_i - \bar{y}_i)/\bar{y}_i]^2} \quad \text{EQ. 2}$$

where N is the total number of data points used in the training, $y_i$ is the predicted output, and $\bar{y}_i$ is the target output.

Figure 8:
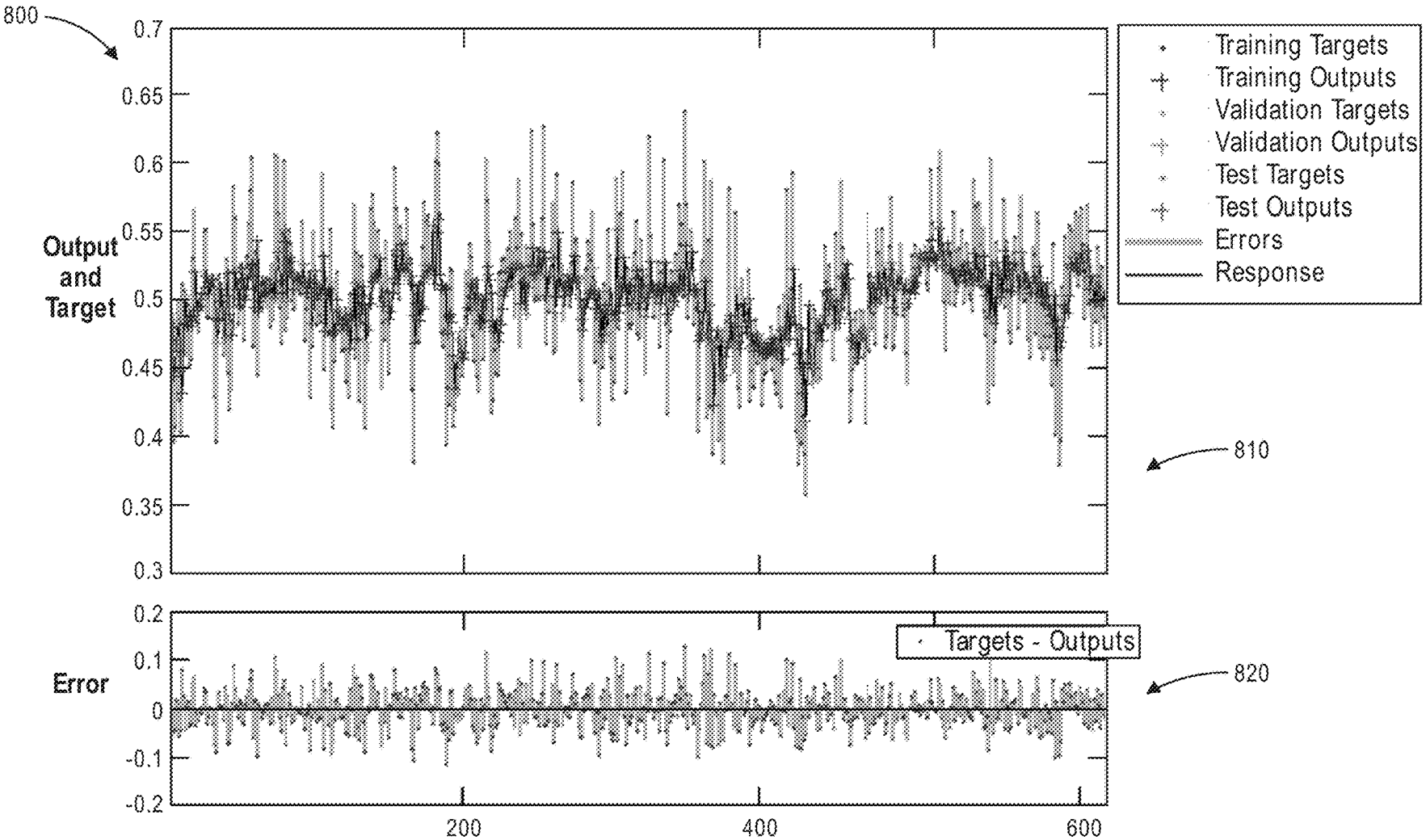
FIG. 8 illustrates a graph that illustrates training a neural network using gap impedance, according to an embodiment.

FIG. 8 illustrates a graph 800 that illustrates training a neural network using gap impedance, according to an embodiment. The X axis represents the index of each datum depth, and the Y axis represents the gap impedance data.

During the training phase, the input-output data is divided into three parts: training data, validation data, and test data. The percentage of each part in the total data set can be specified as setting-up parameters before running the neural network. The training set is used to train the network. Training continues as long as the neural network continues improving on the validation set. The test set provides an independent measure of the accuracy of the neural network. As shown in FIG. 8, the top track 810 illustrates the output for each part: training targets, training outputs, validation targets, validation outputs, test targets and test outputs. The error is also plotted and represents the differences between the target output and the validation outputs output from the neural network. The error is also plotted in the bottom track 820.

In one embodiment, the neural network may be or include dynamic modeling that is provided in a neural network toolbox. The implementation may be or include:

- Non-linear auto-regressive with external input (NARX) neural network
- Multi-layer feedback neural network
- Two modes: open loop and closed loop
- The number of neurons, hidden layers, and delay points may be changed
- Training method Levenburg-Marquardt Although use of a neural network is described above, in other embodiments, the formation resistivity may also or instead be determined by solving one or more inverse algorithms.

The method 700 may also include steering the downhole tool 100 based at least partially upon the formation resistivity, as at 716. In one embodiment, this may include transmitting a signal (e.g., EM signal, mud pulse signal, vibration signal) from the surface (e.g., from the computing system 900) to the downhole tool 100 with instructions to steer the drill bit 122 based at least partially upon the gap voltage (measured at 706), the gap current (measured at 708), the gap impedance (determined at 712), the formation resistivity (determined at 714), or a combination thereof. Thus, the downhole tool 100 may receive the signal and steer the drill bit 122 in response thereto. Steering the drill bit 122 may include varying the inclination angle, the azimuthal angle, or both. In another embodiment, the operator or the computing system 900 may steer the downhole tool 100 by performing one or more actions at the surface such as varying a rate of rotation of the drill string 240, varying a torque on the drill string 240, varying a weight on the drill bit 122, etc. The downhole or surface variations to steer the downhole tool 100 may take place while drilling is occurring. In another embodiment, the drilling may be paused to make the surface or downhole variations to steer the downhole tool 100.

Relative changes in the formation resistivity may indicate boundaries between formation layers. As mentioned above, the operator may be able to estimate the formation resistivity of the desired formation layer. In one example, if the downhole tool 100 is in the desired formation layer (e.g., reservoir or target zone), and the formation resistivity (determined at 714) indicates that the formation resistivity is changing, indicating that the downhole tool 100 is crossing a boundary into another formation layer, then the operator may steer the downhole tool 100 back into the desired formation layer. In another example, if the downhole tool 100 is not in the desired formation layer (e.g., reservoir or target zone), and the formation resistivity (determined at 714) indicates that the formation resistivity is changing, indicating that the downhole tool 100 is crossing a boundary into the desired formation layer, then the operator may steer the downhole tool 100 into the desired formation layer.

In at least one embodiment, steering the downhole tool 100 based at least partially upon the formation resistivity may include generating a graph (e.g., a formation resistivity curtain plot), similar to the graph 600 shown in FIG. 6. For example, the graph may include one or more of the tracks 610, 620, 630, 640. An operator may compare the data in the graph to the estimated formation resistivity for the desired formation layer to facilitate steering the downhole tool 100 such that the downhole tool 100 is directed toward the desired formation layer or remains in the desired formation layer.

The method 700 may include a plurality of iterations. For example, one or more portions of the method 700 may be performed at a plurality of depths and/or times. This may allow the formation resistivity to be determined (at 714) at a plurality of depths and/or times. This may allow the operator or the computing system 900 to detect relative changes in the formation resistivity. For example, when the formation resistivity changes by more than a predetermined amount between two or more consecutive depths and/or times, this may indicate that the downhole tool 100 (e.g., the drill bit 122 and/or the gap sub 130) is crossing a boundary from one formation layer to another formation layer. This may trigger the operator or the computing system 900 to steer the downhole tool 100 in a different direction/trajectory.

Potential Applications

The system and method disclosed herein may be implemented in a qualitative resistivity indicator. MWD tools measure and/or use total gamma counts to identify formations. Gamma radiation is not sensitive to resistivity and is a shallow measurement. Gap impedance is sensitive to resistivity; however, unlike induction tools or other tools designed for formation evaluation, the response of the impedance gap may not be focused and may not be sensitive to thin formations.

The system and method disclosed herein may also or instead be implemented in a producibility estimator. An approximate resistivity log for lateral wells may enable an operator to quantify the footage placed in the desired hydrocarbon-bearing formation. Reservoir models may be created based at least partially upon the impedance gap for a given basin, and historical producibility for each wellbore can be related to the impedance gap recorded when the wellbore was drilled.

The system and method disclosed herein may also or instead be used for early boundary detection. The impedance gap may transition upon the drill bit contact entering a formation or crossing a boundary. The detection can be substantially instantaneous, depending upon resistivity contrast and mud resistivity.

The system and method disclosed herein may also or instead be used for look-ahead boundary detection. If the measurement has at least a predetermined level of sensitivity, look-ahead boundary detection may be possible.

Figure 9:
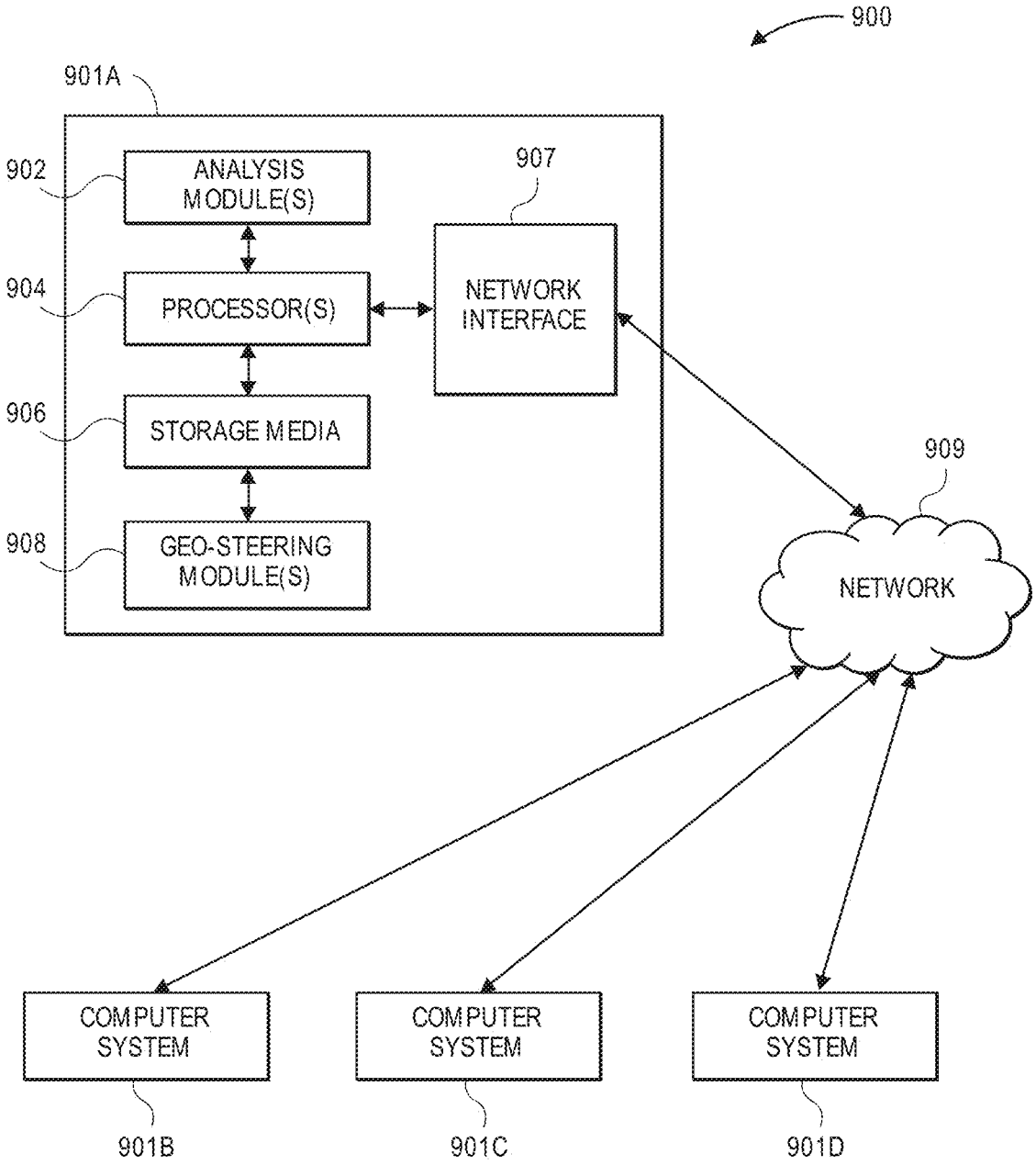
FIG. 9 illustrates a schematic view of a computing system for performing at least a portion of the method disclosed herein, according to an embodiment.

FIG. 9 illustrates a schematic view of a computing or processor system for performing the method, according to an embodiment. The computing system 900 may include a computer or computer system 901A, which may be an individual computer system 901A or an arrangement of distributed computer systems. The computer system 901A includes one or more analysis modules 902 that are configured to perform various tasks according to some embodiments, such as one or more methods disclosed herein. To perform these various tasks, the analysis module 902 executes independently, or in coordination with, one or more processors 904, which is (or are) connected to one or more storage media 906. The processor(s) 904 is (or are) also connected to a network interface 907 to allow the computer system 901A to communicate over a data network 909 with one or more additional computer systems and/or computing systems, such as 901B, 901C, and/or 901D (note that computer systems 901B, 901C and/or 901D may or may not share the same architecture as computer system 901A, and may be located in different physical locations, e.g., computer systems 901A and 901B may be located in a processing facility, while in communication with one or more computer systems such as 901C and/or 901D that are located in one or more data centers, and/or located in varying countries on different continents).

A processor can include a microprocessor, microcontroller, processor module or subsystem, programmable integrated circuit, programmable gate array, or another control or computing device.

The storage media 906 can be implemented as one or more computer-readable or machine-readable storage media. Note that while in some example embodiments of FIG. 9 storage media 906 is depicted as within computer system 901A, in some embodiments, storage media 906 may be distributed within and/or across multiple internal and/or external enclosures of computing system 901A and/or additional computing systems. Storage media 906 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLUERAY® disks, or other types of optical storage, or other types of storage devices. Note that the instructions discussed above can be provided on one computer-readable or machine-readable storage medium, or alternatively, can be provided on multiple computer-readable or machine-readable storage media distributed in a large system having possibly plural nodes. Such computer-readable or machine-readable storage medium or media is (are) considered to be part of an article (or article of manufacture). An article or article of manufacture can refer to any manufactured single component or multiple components. The storage medium or media can be located either in the machine running the machine-readable instructions, or located at a remote site from which machine-readable instructions can be downloaded over a network for execution.

In some embodiments, computing system 900 contains one or more geo-steering module(s) 908 for performing at least a portion of the method 700. It should be appreciated that computing system 900 is but one example of a computing system, and that computing system 900 may have more or fewer components than shown, may combine additional components not depicted in the example embodiment of FIG. 9, and/or computing system 900 may have a different configuration or arrangement of the components depicted in FIG. 9. The various components shown in FIG. 9 may be implemented in hardware, software, or a combination of both hardware and software, including one or more signal processing and/or application specific integrated circuits.

Further, the steps in the processing methods described herein may be implemented by running one or more functional modules in information processing apparatus such as general-purpose processors or application specific chips, such as ASICs, FPGAs, PLDs, or other appropriate devices. These modules, combinations of these modules, and/or their combination with general hardware are included within the scope of protection of the invention.

Geologic interpretations, models and/or other interpretation aids may be refined in an iterative fashion; this concept is applicable to methods as discussed herein. This can include use of feedback loops executed on an algorithmic basis, such as at a computing device (e.g., computing system 900, FIG. 9), and/or through manual control by a user who may make determinations regarding whether a given step, action, template, model, or set of curves has become sufficiently accurate for the evaluation of the subsurface three-dimensional geologic formation under consideration.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to explain at least some of the principals of the disclosure and their practical applications, to thereby enable others skilled in the art to utilize the disclosed methods and systems and various embodiments with various modifications as are suited to the particular use contemplated.

What is claimed is:

1. A method for steering a downhole tool, comprising:

receiving a first electromagnetic (EM) signal from the downhole tool, wherein the downhole tool is in a wellbore in a formation, and wherein the first EM signal comprises first measurement data obtained by the downhole tool;

receiving a second EM signal from the downhole tool a predetermined duration after receiving the first EM signal, wherein the second EM signal comprises second measurement data comprising a gap voltage and a gap current that are measured across a gap sub in the downhole tool when the first EM signal is transmitted from the downhole tool at a first location in the wellbore;

determining a gap impedance based at least partially upon the gap voltage and the gap current of the second measurement data;

determining a first formation resistivity at the first location in the wellbore based at least partially upon the gap impedance of the second measurement data and a trained neural network comprising a library of gap impedance data measured in one or more other wellbores in the formation; and steering the downhole tool based at least partially upon the first formation resistivity, wherein steering comprises varying an inclination angle of the downhole tool, the azimuthal angle of the downhole tool, or both.

2. The method of claim 1, wherein determining the first formation resistivity comprises comparing the gap impedance of the second measurement data to gap impedance data in a library.

3. The method of claim 2, wherein the library also comprises formation resistivity data corresponding to the gap impedance data, and wherein the formation resistivity data is estimated in the one or more other wellbores in the formation.

4. The method of claim 1, comprising:

receiving a third EM signal from the downhole tool after receiving the second EM signal, wherein the third EM signal comprises third measurement data comprising a second gap voltage and a second gap current that are measured across the gap sub in the downhole tool when the second EM signal is transmitted from the downhole tool at the second location in the wellbore;

determining a second gap impedance based at least partially upon the second gap voltage and the second gap current of the third measurement data;

determining a second formation resistivity at the second location in the wellbore based at least partially upon the second gap impedance; and determining a difference between the first formation resistivity and the second formation resistivity, wherein the difference indicates a boundary between a first layer of the formation at the first location and a second layer of the formation at the second location, wherein the boundary is between the gap sub and a drill bit of the downhole tool.

5. The method of claim 4, comprising:

receiving a fourth EM signal from the downhole tool after receiving the third EM signal, wherein the fourth EM signal comprises fourth measurement data comprising a third gap voltage and a third gap current that are measured across the gap sub in the downhole tool when the third EM signal is transmitted from the downhole tool at the third location in the wellbore;

determining a third gap impedance based at least partially upon the third gap voltage and the third gap current of the fourth measurement data;

determining a third formation resistivity at the third location in the wellbore based at least partially upon the third gap impedance; and determining a second difference between the second formation resistivity and the third formation resistivity, wherein the second difference indicates a second boundary between the second layer of the formation at the second location and a third layer of the formation at the third location, wherein the second boundary is between the gap sub and the drill bit of the downhole tool.

6. The method of claim 1, wherein the first formation resistivity is determined based at least partially upon a vertical sensitivity of the gap impedance, and wherein the vertical sensitivity of the gap impedance is greater when a distance between the gap sub and a drill bit of the downhole tool is greater than a thickness of a layer of the formation in which the downhole tool is positioned than when the distance between the gap sub and the drill bit is less than the thickness of the layer of the formation in which the downhole tool is positioned.

7. The method of claim 1, wherein the gap impedance is determined based at least partially upon a resistivity contrast of a fluid in the wellbore.

8. The method of claim 1, further comprising determining a type of fluid in the wellbore proximate to the downhole tool, wherein the first formation resistivity is also determined based at least partially upon the type of the fluid.

9. The method of claim 1, further comprising:

receiving a third EM signal from the downhole tool after receiving the second EM signal, wherein the third EM signal comprises third measurement data comprising a second gap voltage and a second gap current that are measured across the gap sub in the downhole tool when the second EM signal is transmitted from the downhole tool at the second location in the wellbore;

determining a second gap impedance based at least partially upon the second gap voltage and the second gap current of the third measurement data;

determining a second formation resistivity at the second location in the wellbore; and determining a difference between the first formation resistivity and the second formation resistivity, wherein the difference indicates a boundary between a first layer of the formation and a second layer of the formation, and wherein steering the downhole tool comprises steering a drill bit of the downhole tool to remain within the first layer of the formation.

10. The method of claim 1, further comprising:

receiving a third EM signal from the downhole tool after receiving the second EM signal, wherein the third EM signal comprises third measurement data comprising a second gap voltage and a second gap current that are measured across the gap sub in the downhole tool when the second EM signal is transmitted from the downhole tool at the second location in the wellbore;

determining a second gap impedance based at least partially upon the second gap voltage and the second gap current of the third measurement data;

determining a second formation resistivity at the second location in the wellbore; and determining a difference between the first formation resistivity and the second formation resistivity, wherein the difference indicates a boundary between a first layer of the formation and a second layer of the formation, and wherein steering the downhole tool comprises steering a drill bit of the downhole tool to enter the second layer of the formation.

11. A method for steering a drill bit of a downhole tool, comprising:

transmitting a first electromagnetic (EM) signal from the downhole tool to a computing system at the surface, wherein the downhole tool is in a wellbore in a formation and the first EM signal comprises first measurement data obtained by the downhole tool;

measuring a gap voltage across a gap sub in the downhole tool while the first EM signal is being transmitted, wherein the gap voltage is generated by transmitting the first EM signal;

measuring a gap current across the gap sub in the downhole tool while the first EM signal is being transmitted, wherein the gap current is generated by transmitting the first EM signal;

transmitting a second EM signal from the downhole tool to the computing system after a predetermined duration less than 5 minutes from transmitting the first EM signal, wherein the second EM signal comprises second measurement data comprising the gap voltage generated by transmitting the first EM signal and the gap current generated by transmitting the first EM signal; and steering the drill bit based at least partially upon the gap voltage and the gap current of the second measurement data.

12. The method of claim 11, further comprising receiving a third signal from the computing system using the downhole tool, wherein the third signal comprises instructions to steer the drill bit based at least partially upon a second gap voltage generated by transmitting the second EM signal and a second gap current generated by transmitting the second EM signal.

13. The method of claim 12, further comprising determining, using the computing system, a second gap impedance based at least partially upon the second gap voltage and the second gap current.

14. The method of claim 13, further comprising determining, using the computing system, a formation resistivity based at least partially upon the gap impedance, a trained neural network comprising a library of gap impedance data measured in one or more other wellbores in the formation, and a resistivity of a fluid in the wellbore, wherein determining the formation resistivity comprises comparing the gap impedance to gap impedance data in the library, wherein the library also comprises formation resistivity data corresponding to the gap impedance data, and wherein the formation resistivity data is estimated in the one or more other wellbores in the formation.

15. The method of claim 14, wherein the drill bit is steered based at least partially upon the formation resistivity.

16. A system, comprising:

a downhole tool configured to transmit a first electromagnetic (EM) telemetry signal and a second EM telemetry signal, wherein the downhole tool comprises:

a gap sub; and a sensor configured to measure a gap voltage and a gap current across the gap sub when transmitting the first EM telemetry signal at a first location; and a computing system configured to:

receive the first EM telemetry signal and the second EM telemetry signal, wherein the second EM telemetry signal comprises first measurement data comprising the gap voltage generated by transmitting the first EM telemetry signal and the gap current generated by transmitting the first EM telemetry signal;

determine a gap impedance based at least partially upon the gap voltage and the gap current of the first measurement data;

determine a formation resistivity around the downhole tool based at least partially upon the gap impedance and a trained neural network comprising a library of gap impedance data measured in one or more other wellbores in the formation; and steer the downhole tool based at least partially upon the formation resistivity, wherein steering comprises varying an inclination angle of the downhole tool, the azimuthal angle of the downhole tool, or both.

17. The system of claim 16, wherein determining the formation resistivity comprises comparing the gap impedance to gap impedance data in a library, wherein the library also comprises formation resistivity data corresponding to the gap impedance data, and wherein the formation resistivity data is estimated in the formation.

18. The system of claim 16, wherein the downhole tool is configured to transmit a third EM telemetry signal, and the sensor is configured to measure a second gap voltage and a second gap current when transmitting the second EM telemetry signal at a second location, and the computing system is configured to:

receive the third EM signal that comprises second measurement data comprising the second gap voltage and the second gap current;

determine a second gap impedance based at least partially upon the second gap voltage and the second gap current of the second measurement data;

determine a second formation resistivity at the second location in the wellbore based at least partially upon the second gap impedance; and determine a difference between the formation resistivity at the first location in the wellbore and the second formation resistivity, wherein the difference indicates a boundary between a first layer of the formation at the first location and a second layer of the formation at the second location, wherein the boundary is between the gap sub and a drill bit of the downhole tool.

19. The system of claim 16, wherein a change in the formation resistivity indicates a boundary between a first layer of the formation and a second layer of the formation, and wherein steering the downhole tool comprises steering the downhole tool to remain within the first layer of the formation.

20. The system of claim 16, wherein a change in the formation resistivity indicates a boundary between a first layer of the formation and a second layer of the formation, and wherein steering the downhole tool comprises steering the downhole tool to enter the second layer of the formation.

* * * * *